US007109880B2

(12) United States Patent
Sibalich et al.

(10) Patent No.: US 7,109,880 B2
(45) Date of Patent: Sep. 19, 2006

(54) CEILING MOUNT LIGHT WITH 360-DEGREE MOTION SENSOR

(75) Inventors: Gregory L. Sibalich, Bowling Green, KY (US); Chik Kin Wing Ricky, Tuen Mun (HK); Roger Dennis Cornett, Bowling Green, KY (US)

(73) Assignee: Desa IP LLC, Miami, FL (US)

( * ) Notice: Subject to any disclaimer, the term of this patent is extended or adjusted under 35 U.S.C. 154(b) by 165 days.

(21) Appl. No.: 10/799,464

(22) Filed: Mar. 12, 2004

(65) Prior Publication Data

US 2005/0200495 A1 Sep. 15, 2005

(51) Int. Cl.
*G08B 23/00* (2006.01)

(52) U.S. Cl. ..... 340/693.6; 340/693.5; 340/693.9

(58) Field of Classification Search ..... 340/693.5, 340/693.6, 693.9, 693.12, 545.3, 309.16, 340/309.9; 315/155, 159, 194; 362/84, 362/276

See application file for complete search history.

(56) References Cited

U.S. PATENT DOCUMENTS

D87,377 S 7/1932 Andrews ..... D26/88
4,717,910 A * 1/1988 Scripps et al. ..... 340/693.1
4,823,051 A * 4/1989 Young ..... 315/155
D341,441 S 11/1993 Shapiro ..... D26/118
5,590,953 A * 1/1997 Haslam et al. ..... 362/276
5,626,417 A 5/1997 McCavit ..... 362/276
5,662,411 A 9/1997 Haslam et al. ..... 362/276
6,100,803 A 8/2000 Chang ..... 340/567
6,151,529 A * 11/2000 Batko ..... 700/28
6,168,282 B1 * 1/2001 Chien ..... 362/84
6,940,230 B1 * 9/2005 Myron et al. ..... 315/159
2003/0117803 A1 6/2003 Chen

FOREIGN PATENT DOCUMENTS

CA 2277645 * 1/2001

* cited by examiner

*Primary Examiner*—Van T. Trieu
(74) *Attorney, Agent, or Firm*—Alexander P. Brackett; Middleton Reutlinger

(57) ABSTRACT

A ceiling mount light with a single spherical lens with a 360-degree range viewing field to focus infrared energy into a motion sensor is provided. The ceiling mount light has a sensitivity regulating switch to adjust the level of sensitivity up to about 30 feet in the 360-degree viewing field.

33 Claims, 6 Drawing Sheets

CEILING MOUNT LIGHT WITH 360-DEGREE MOTION SENSOR

CROSS-REFERENCE TO RELATED APPLICATIONS

Not applicable

BACKGROUND OF THE INVENTION

1. Field of the Invention

The present invention relates to a ceiling mount light with a motion sensor. More specifically, this invention relates to a ceiling mount light with a single spherical-shaped lens to provide 360-degrees of motion-sensing coverage in any direction, whereby motion sensitivity can be adjusted up to about 30 feet in any direction with light mounted at 8 feet.

2. Description of the Related Art

Conventional decorative wall mounted light fixtures with motion sensors are available for serving as light sources in a variety of areas, such as passageways, streets, parking lots, and gardens, and are energy-efficient and have longer lifetimes due to their non-successive use. Passive infrared sensors have been utilized in various motion-sensing devices, such as light fixtures, to sense and alert the motion and/or presence of a person. Improvements came about when these passive infrared sensors were developed to include a number of lenses, facets, and detector heads, all of which can be oriented so that a person can be detected.

SUMMARY OF THE INVENTION

In view of known deficiencies associated with earlier motion detection light fixtures, the present invention is an motion activated ceiling mount light fixture which has at least one illumination source and a single spherical-shaped lens and a single motion sensor which can detect movement of heat in a 360-degree range viewing field. The motion detector assembly is removably mounted to the base plate and positioned within the lamp shade assembly such that the single spherical lens protrudes through a hollow recess, or opening, in the lamp shade assembly, which in turn is removably mounted to the base plate.

The motion sensor may be set to a set sensitivity range such that when a heat source passes within the 360-degree range viewing field, within the set sensitivity range, the luminaire emits a luminance for a set period of time, and within the set sensitivity range, the infrared motion sensing ceiling mount light may emit a lower lighting level when a heat source is not passing near the sensor. Integrated passive infrared electronics may be used as the motion sensing component mounted in the lamp housing which covers the electrical components of the light fixture. Optionally, the sensitivity regulating switch may be used to adjust the level of sensitivity of the motion sensor up to about 30 feet in any direction with light mounted 8 feet from the ground and the time regulating switch may be used to adjust the length of illumination after detection by the motion sensor. The lamp shade assembly may include a support frame, a base frame, a decorative ring encircling the hollow recess or opening, and a plurality of panels, which may be of glass. The base frame may include socket assemblies for light bulbs and a cross bar assembly to mount the fixture to the electrical junction box in the ceiling.

In another embodiment, the ceiling mount light for motion sensing may include a single spherical lens, a motion sensor with a 360-degree range viewing field, a motion detector case encasing a switch cover, a time regulating switch, two level lighting control switch and a sensitivity regulating switch, which is used to adjust the level of sensitivity of the motion sensor up to about 30 feet in any direction with light mounted 8 feet high. A rubber plug and an extension cylinder are positioned between the printed circuit board assembly and a heat shield. The lamp shade assembly has a support frame, a frame base, a bottom panel, a plurality of side panels, and a decorative ring encircling a hollow recess or opening positioned in the middle of the bottom panel. The frame base of the lamp shade assembly is removably mounted to the base plate. The motion detector assembly is also removably mounted to the base plate and positioned within the lamp shade assembly such that the single spherical lens protrude through the hollow recess in the lamp shade assembly.

Optionally, the bottom panel and the side panels are glass panels, and the bottom panel may be partitioned into multiple individual panels. The single spherical lens may be encircled with a heat sink and a partition may be positioned between the single spherical lens and a circuit control board. The heat sink may be attached to an internal triac to allow the required power to be dissipated by the device and the partition may be utilized for UL safety requirements in order to prevent access to the electronics.

In another embodiment, the motion detector includes a lamp shade assembly, a motion detector assembly, and a base plate. The motion detector assembly has a single spherical lens protruding through a hollow recess in the lamp shade assembly and is positioned on a circuit board assembly. A sensitivity regulating switch is used to adjust motion sensitivity up to about 30 feet in any direction, and the motion sensor detects motion in a 360-degree range of viewing field.

The hollow recess through which the single spherical lens protrudes may be located in the center of the lamp shade assembly. A switch case may envelop the printed circuit board assembly, a sensitivity regulating switch, a time regulating, a two level lighting control switch and switch covers. The time regulating switch may be used to adjust the length of time of illumination after motion detection. Optionally, a heat sink may encircle the single spherical lens, and a rubber plug and an extension may be removably mounted on the base plate and positioned between the printed circuit board assembly and a heat shield. A partition may be positioned between the printed circuit board assembly and the single spherical lens. The lamp shade assembly may have a support frame, a frame base mounted to the base plate, a bottom panel, side panels, and a decorative ring encircling the hollow recess. The bottom panel may be divided into a plurality of individual panels. The base plate may comprise socket assemblies and a cross bar assembly for mounting the motion detector to the electrical junction box in the ceiling.

For a better understanding of the present invention, together with other and further objects thereof, reference is made to the following description, taken in conjunction with the accompanying drawings, and its scope will be pointed out in the appending claims.

BRIEF DESCRIPTION OF THE DRAWINGS

Embodiments of the present invention are described below, by way of example only, with reference to the accompanying drawings in which.

DETAILED DESCRIPTION OF THE PREFERRED EMBODIMENT

Figure 1:
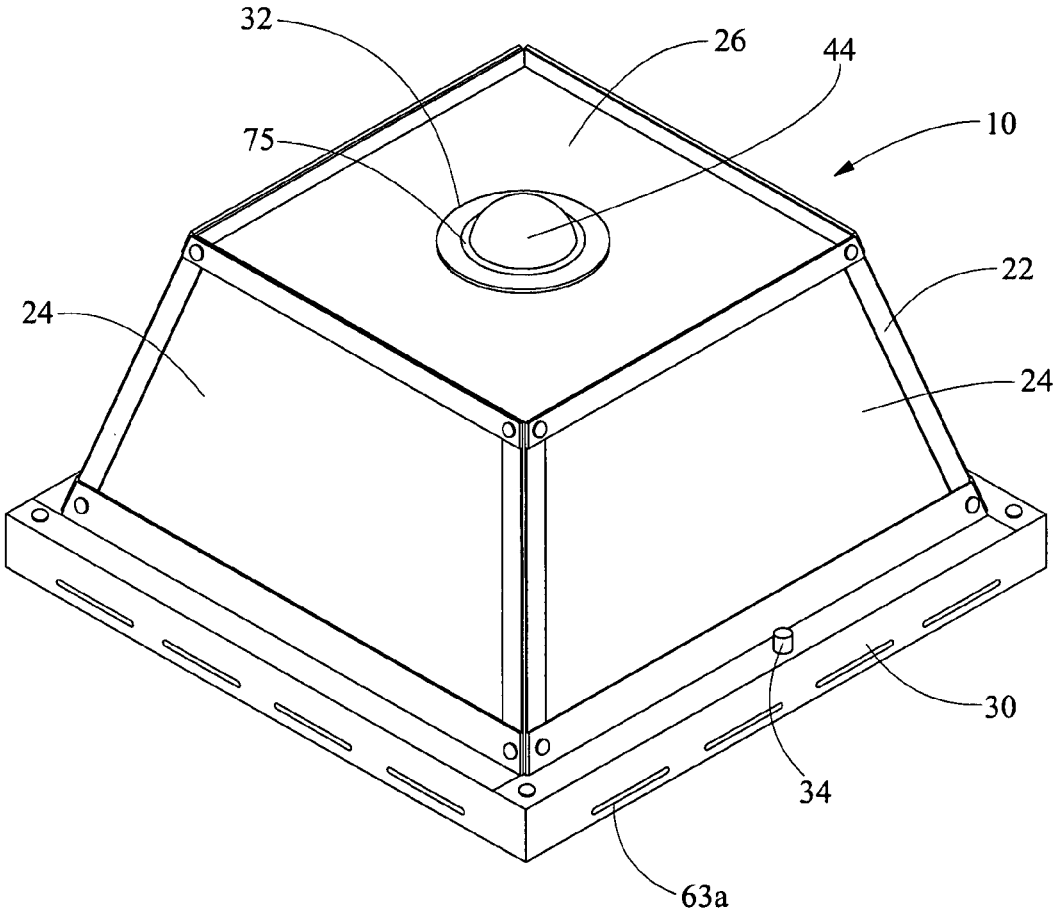
FIG. 1 is an inverted bottom view of a first embodiment of the ceiling mount light.
Figure 2:
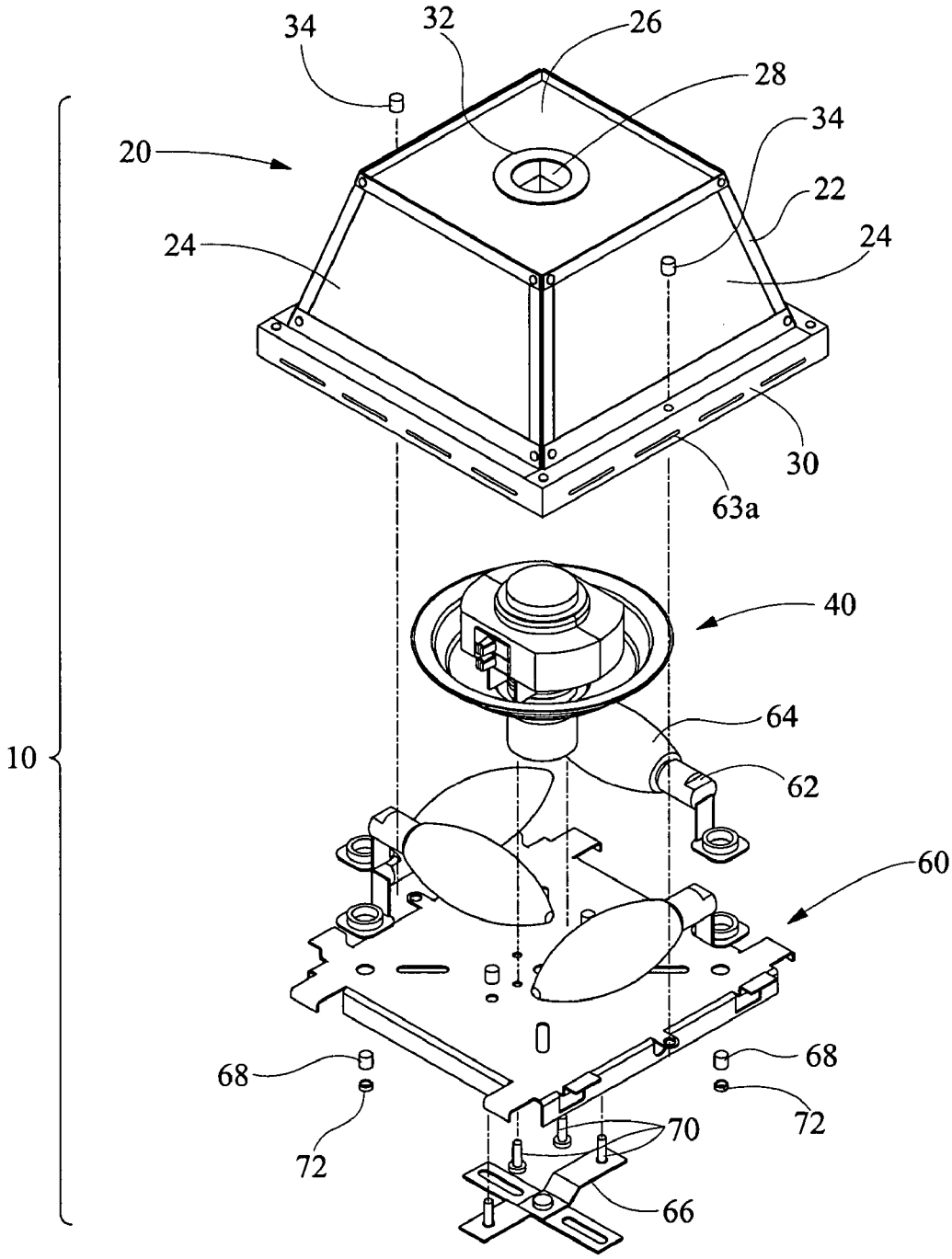
FIG. 2 is an exploded view of a first embodiment of the ceiling mount light.
Figure 3:
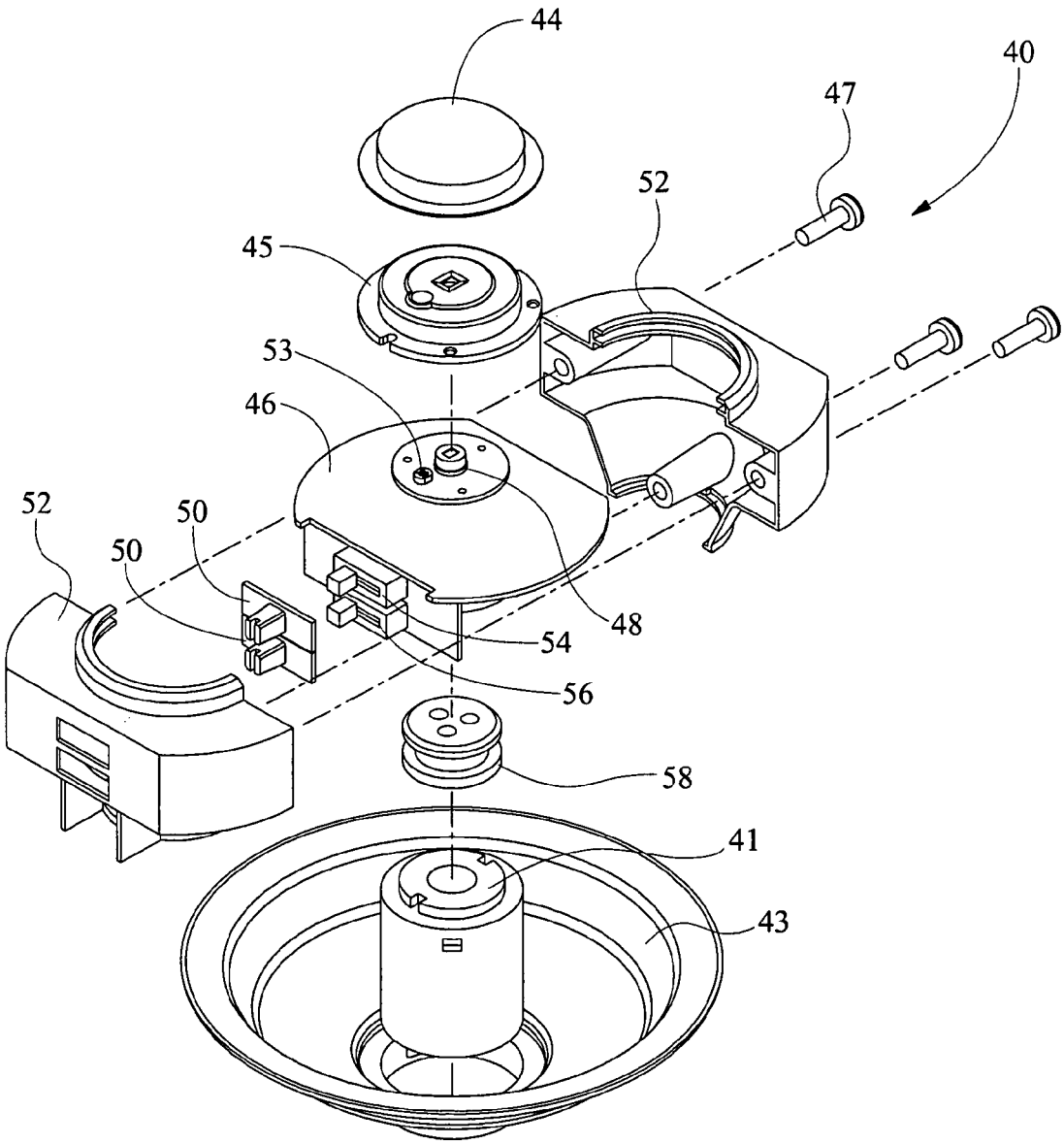
FIG. 3 is an exploded view of a first embodiment of the motion detector assembly of the ceiling mount light.

While this invention is susceptible of embodiments in many different forms, there are shown in the figures and will herein be described in detail, preferred embodiments of the invention with the understanding that the present disclosure is to be considered as an exemplification of the principles of the invention, and is not intended to limit the broad aspects of the invention to the embodiments illustrated.

FIGS. 1–6 illustrate the ceiling mount light in an inverted position. Referring to the drawings and initially FIGS. 1–3, a ceiling mount light with a 360-degree range of motion sensing in accordance with a first embodiment 10 of the present invention generally comprises a lamp shade assembly 20, a motion detector assembly 40, and a base plate 60.

The lamp shade assembly 20 may have a plurality of side panels 24 and a bottom panel 26. The panels may be glass or some other transparent or translucent material known in the art. The side panels 24 and the bottom panel 26 are supported by a support frame 22 and a frame base 30. The frame base 30 of the lamp shade assembly 20 is removably mounted to the base plate 60 in some manner, such as with a decorative nut 34, base screws 68, and base nuts 72. In the center of the bottom panel 26 of the lamp shade assembly 20 is a decorative ring 32 surrounding a hollow recess 28 through which the spherical lens 44 protrudes.

The motion sensor 48 of the motion detector assembly 40 is positioned inside the spherical lens 44 and is positioned in the center of a printed circuit board assembly 46. The motion sensor 48 is used to detect movement, and the motion sensor 48 may be a passive infrared sensor, such as, for example, Model RE200B from Nippon Ceramic Co., Ltd., and Model LHi 778 from Perkin Elmer Optoelectronics. A photocell 53 may also be utilized as a part of the electronics to make sure that the lights do not come on in the daytime. The photocell 53 is activated through light passing through spherical lens 44 and provides adequate light response to prevent on-off cycling of the light when the light is activated. A spherical partition 45 may be used to separate the spherical lens 44 from the printed circuit board assembly 46 in order to isolate the electronics from the user to prevent access to the electronics. Further, the photocell may be recessed thereby increasing the accuracy of the dark detection scheme utilized by the electronics. A time regulating switch 54 and a sensitivity regulating switch are attached to the printed circuit board assembly 46 which may be a single pole mechanical slide switch to connect different fixed resistor values to change the timing or the sensitivity of the sensor. The time regulating switch 54 and the sensitivity regulating switch 56 positioned within the motion detector assembly 40 may be adjustable switches, a variable resistor, or a variable capacitor, for manually adjusting the length of time the illumination stays on and the level of sensitivity of the motion detector. The time regulating switch 54 and sensitivity regulating switch 56 may each be covered with a switch cover 50. The printed circuit board assembly 46, the motion sensor 48, the time regulating switch 54, the sensitivity regulating switch 56, and each switch cover 50 may be enveloped in a switch case 52, which is partitioned for assembly and each part is detachable with case screws 47.

Directly above the printed circuit board assembly 46 on the opposing side of the motion sensor 48 is a rubber plug 58 which has a plurality of openings through which electrical wiring can be threaded. Rubber plug 58 prevents the ingress of moisture into the electrical compartment of the motion sensor assembly 40. The rubber plug 58 is mounted to a hollow extension cylinder 41, through which electrical wiring can be threaded. The extension cylinder 41 fits snuggly through a heat shield 43 and is attached to the center of the base plate 60 by screws 70 or other attachment mechanisms. Motion sensors in general tend to malfunction when the ceiling mount light temperature increases above about 40° C., and the heat shield 43 serves to isolate the motion sensor 48 from radiant heat generated by the light bulbs. To further prevent heat building up inside the fixture, cross-ventilation is provided in the ceiling mount light 10. Also attached to the base plate are a plurality of socket assemblies 62 for an illumination source, such as a bulb 64. The illumination sources may be incandescent or other light emitting mechanisms known in the art. The base plate 60 is attached to a cross bar assembly 66 with screws 70 and nuts which are used to mount the ceiling mount light 10 to an electrical junction box.

In the embodiments shown, the electronics and the motion detector mechanisms 40 may be kept in close proximity below the heat shield 43 due to the generation of heat from lamps 64. Temperature indications within the lamp shade area 20 may be as high as 100° C. However, since the motion sensor 48 determines movement based upon temperature fluctuations, it is necessary to separate the motion sensor 48 from the higher temperature areas of the lamp shade assembly 20. As shown in the drawings, since the ceiling mount light having 360 degree motion sensing 10 of the present invention is inverted, the heat will tend to rise away from the motion sensor 48 and electronics thereby allowing adequate readings and sensor activation. Further, the fixture 10 may have venting apertures 63*a* formed in the base 30 which acts in conjunction with the aperture or opening 75 to allow air to flow through the interior of the fixture and reduce the heat in the interior thereof. Of course, alternative constructions are available such that the motion sensor 48 may be completely separated from the motion detector electronics. Thus, by referring to the motion detector assembly 40, it is understood that the constituent elements may be placed in alternative and separate locations.

Figure 4:
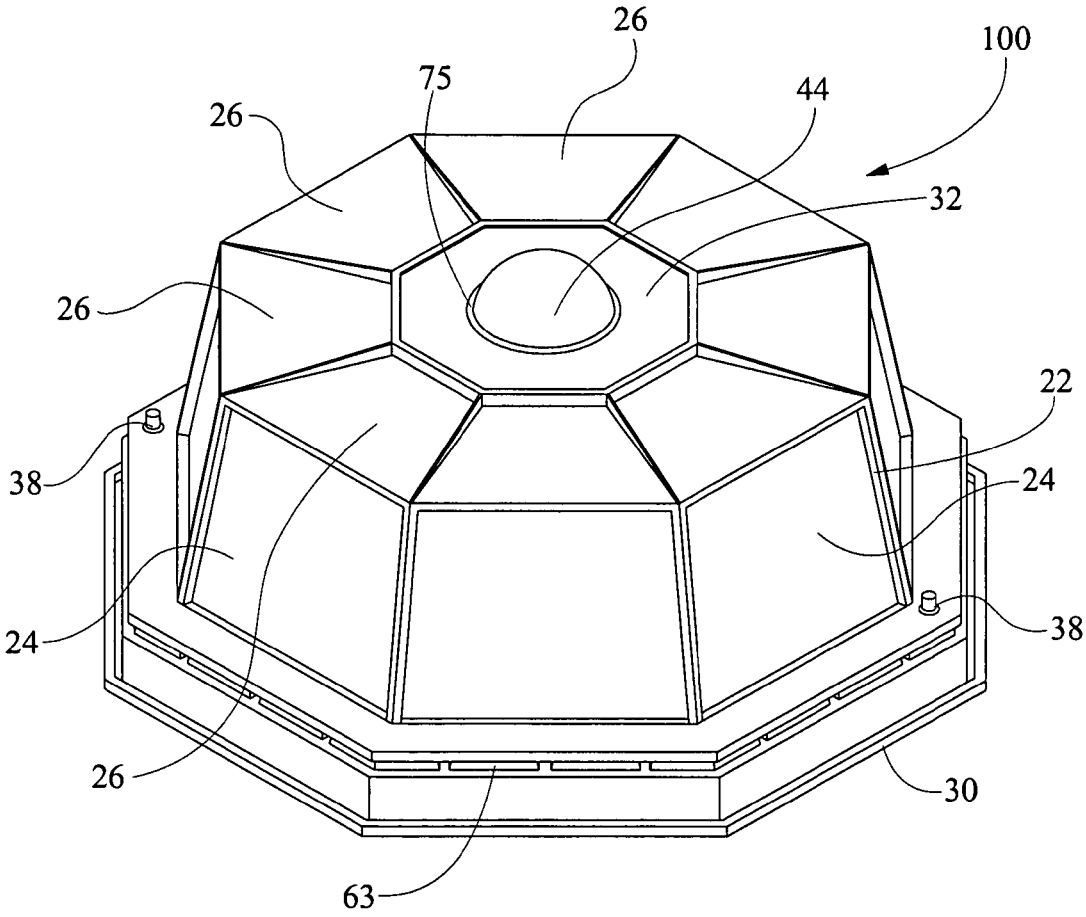
FIG. 4 is an inverted bottom view of a second embodiment of the ceiling mount light.
Figure 5:
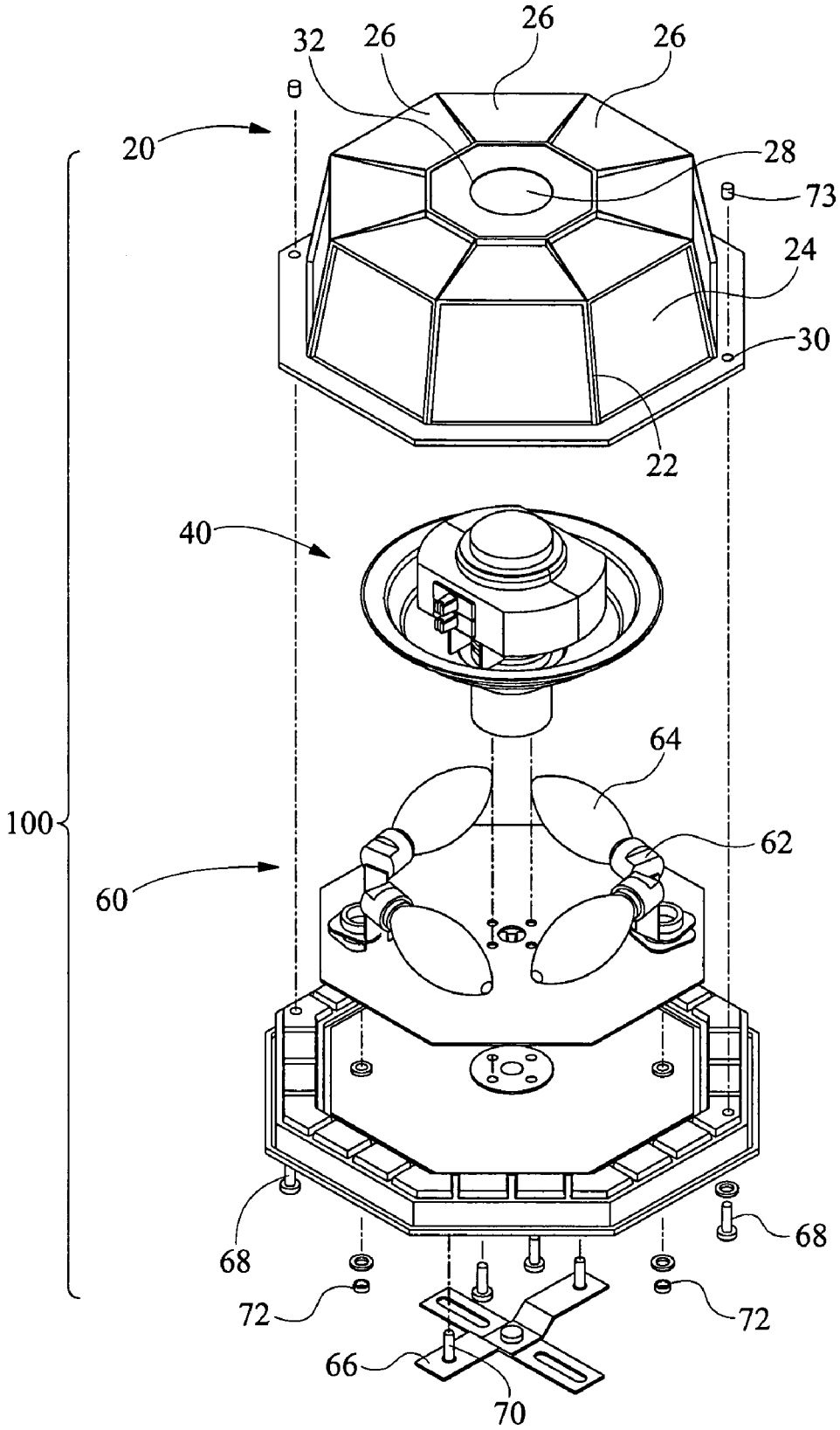
FIG. 5 is an exploded view of a second embodiment of the ceiling mount light.
Figure 6:
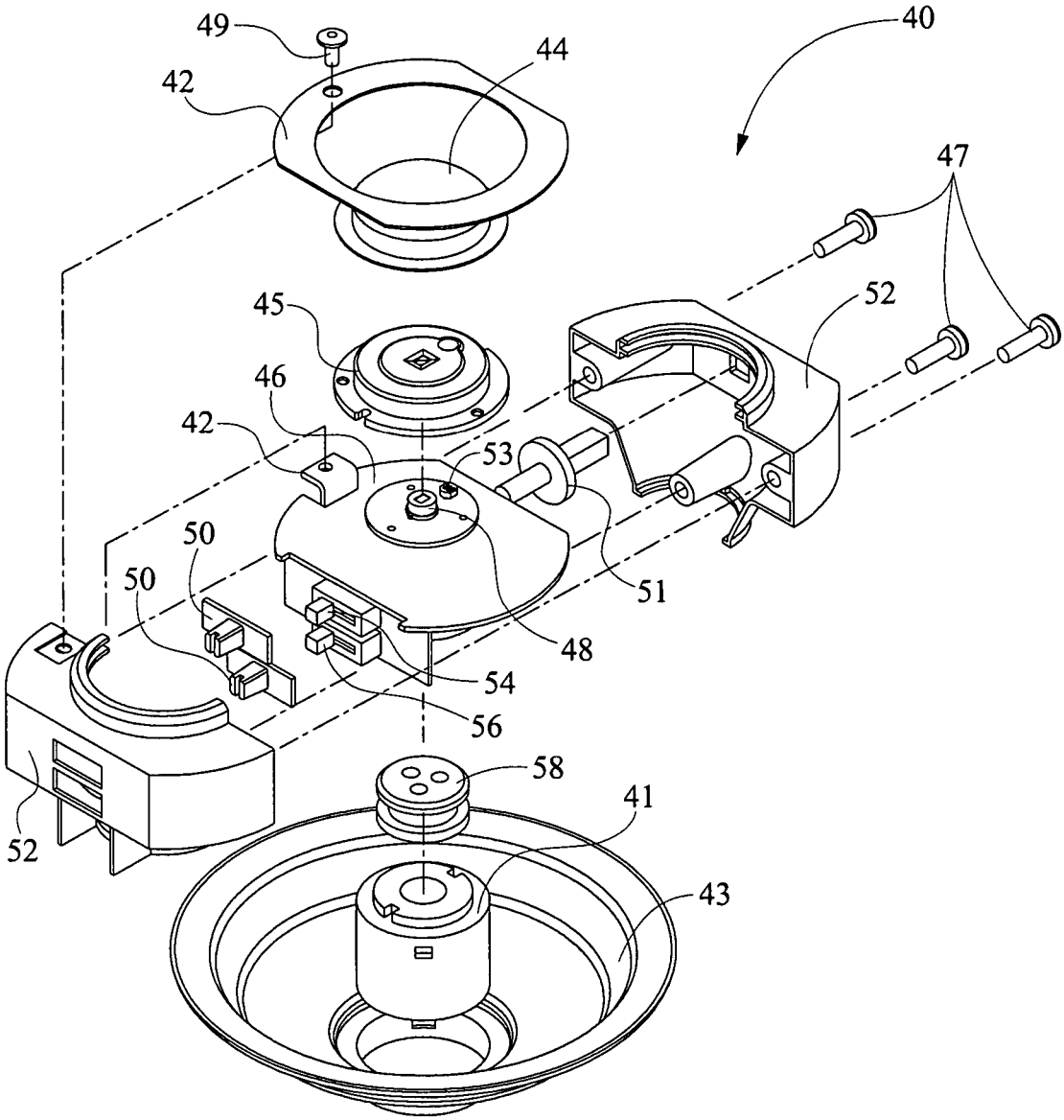
FIG. 6 is an exploded view of a second embodiment of the motion detector assembly of the ceiling mount light.

Referring to a second embodiment 100 of the present invention, FIGS. 4–6, a ceiling mount light with a 360-degree range of motion sensing generally comprises a lamp shade assembly 20, a motion detector assembly 40, and a base plate 60.

The lamp shade assembly 20 has a plurality of side panels 24 and plurality of bottom panels 26. The panels may be glass or some other transparent or translucent material known in the art. The side panels 24 and the bottom panels 26 are supported by a support frame 22 and a frame base 30. The frame base 30 of the lamp shade assembly 20 is removably mounted to the base plate 60 in some manner, such as with hollow rivets 38, base screws 68, and decorative nuts 73. In the center of the bottom panels 26 of the lamp shade assembly 20 is a decorative ring 32 surrounding a hollow recess 28 through which the single spherical lens 44 protrudes.

The motion sensor 48 of the motion detector assembly 40 is positioned inside the single spherical lens 44 and is positioned in the center of a printed circuit board assembly 46. The motion sensor 48 is used to detect the movement of heat and the motion sensor 48 may be a passive infrared sensor. A spherical partition 45 may be used to separate the single spherical lens 44 from the printed circuit board assembly 48 as noted herein. A heat sink 42 may be positioned around the single spherical lens 44 and mounted to a switch case 52 with pop rivet 49 or other attachment mechanisms.

A time regulating switch 54 a two level lighting control switch 56 and a sensitivity regulating switch 74 are attached to the printed circuit board assembly 46. The time regulating switch 54, the two level lighting control switch 56 and sensitivity regulating switch 74 positioned within the motion detector assembly 40 may be adjustable switches, a variable resistor, or a variable capacitor, for manually adjusting the length of time the illumination stays on when motion is sensed, stays on at reduced power level for accent lighting, and the detection range respectively. The level of sensitivity of the motion detector is up to about 30 feet. The time regulating switch 54 and sensitivity regulating switch 74 are each covered with a switch cover 50. The sensitivity regulating switch is externally adjustable with trimpot knob 51. The printed circuit board assembly 46, the motion sensor 48, the time regulating switch 54, the two level lighting control switch 56, the sensitivity regulating switch 74, each switch cover 50 and trimpot knob 51, are enveloped in the motion detector case 52, which is partitioned for assembly and each half is detachable, with case screws 47. The two level lighting control switch 56 may be utilized to allow the lights 64 to emit light at a first low luminance under non-motion sensing conditions, for example 50% illumination, and at a higher luminance when motion is detected by the motion sensor or other motion sensor 48. The time regulating switch 54 may allow the user to select how long after sensing motion the lights remain at a higher output.

Directly above the printed circuit board assembly 46 on the opposing side of the motion sensor 48 is a rubber plug 58 which has a plurality of openings through which electrical wiring can be threaded. The rubber plug 58 prevents ingress of moisture into the electronics compartment of the motion detector assembly 40. The rubber plug 58 is mounted to a hollow extension cylinder 41, through which electrical wiring can be threaded. The extension cylinder 41 fits snuggly through a heat shield 43 and is attached to the center of the base plate 60 with screws 70. Again, since these sensors and a combination of the electronics tend to malfunction when they are in contact with excessive temperatures, the heat shield 43 serves to isolate the motion sensor 48 from radiant heat. To further assist in minimizing buildup of heat in the ceiling mount light 100, ventilation holes 63 positioned between the lamp shade assembly 20 and the base plate 60 and clearance between spherical lens 44 and decorative ring 32 provide cross-ventilation.

Also attached to the base plate are a plurality of socket assemblies 62 for an illumination source, such as a bulb 64. The illumination sources may be any type of incandescent light emitting mechanism as is known in the art of motion activated light fixtures. The base plate 60 is attached to a mounting bracket 66 with mounting screws 70, which is used to mount the ceiling mount light 10 to an electrical junction box.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

We claim:

1. A motion-sensing ceiling mount light, comprising:

a) a motion detector, a lamp shade, and a base plate;

b) said motion detector having a single spherical lens and a motion sensor, wherein said motion sensor has a downwardly directed 360-degree range viewing field;

c) said motion detector connected to a printed circuit board, wherein said printed circuit board, a sensitivity regulating switch, a time regulating switch, and a switch cover are enveloped within a motion detector case; and d) a heat shield anterior to said motion detector case; wherein, e) said motion detector is mounted to said base plate and positioned within said lamp shade such that said single spherical lens of said motion detector protrude through a hollow recess in said lamp shade.

2. The motion-sensing ceiling mount light of claim 1, wherein said motion sensor is a passive infrared sensor for detecting moving sources of infrared radiation.

3. The motion-sensing ceiling mount light of claim 1, wherein said sensitivity regulating switch may be used to adjust a level of sensitivity of said motion sensor up to about 30 feet in any direction with said light mounted approximately 8 feet above the ground.

4. The motion-sensing ceiling mount light of claim 1, wherein said time regulating switch may be used to adjust illumination time after motion is detected.

5. The motion-sensing ceiling mount light of claim 1, wherein said lamp shade further comprises a support frame and a frame base supporting a plurality of glass panels, and a decorative ring encircling said hollow recess.

6. The motion-sensing ceiling mount light of claim 1, wherein said base plate further comprises a plurality of socket assemblies to position one or more illumination sources anterior to said heat shield.

7. The motion-sensing ceiling mount light of claim 6, wherein said base plate further comprises a cross bar on an opposing side of said illumination sources for ceiling mount.

8. A ceiling mount light for sensing motion, comprising:

a) a motion detector assembly having a spherical lens and a motion sensor with a 360-degree range viewing field positioned within said spherical lens;

b) a motion detector case, a switch cover, a time regulating switch, and a sensitivity regulating switch, said motion detector case mounted on a rubber plug and an extension cylinder, said heat shield mounted on said extension cylinder; and c) a lamp shade assembly having a support frame and a frame base framing a bottom panel and a plurality of side panels, said bottom panel having a hallow recess; wherein, d) said frame base of said lamp shade assembly is mounted to a base plate, and said motion detector assembly is mounted to said base plate and positioned within said lamp shade assembly such that said spherical lens protrudes through said hollow recess in said lamp shade assembly.

9. The ceiling mount light for sensing motion of claim 8, wherein said bottom panel and said side panels are glass panels.

10. The ceiling mount light for sensing motion of claim 8, wherein said bottom panel is partitioned into a plurality of individual panels.

11. The ceiling mount light for sensing motion of claim 8, wherein said motion sensor is a passive infrared sensor.

12. The ceiling mount light for sensing motion of claim 8, wherein said time regulating switch may be used to adjust time length of illumination.

13. The ceiling mount light for sensing motion of claim 8, wherein said base plate further comprises a plurality of socket assemblies for an illumination source anterior to said heat shield, and a cross bar assembly for mounting said base plate to a ceiling.

14. The ceiling mount light for sensing motion of claim 8, wherein a partition is positioned adjacent said spherical lens.

15. The ceiling mount light for sensing motion of claim 8, wherein ventilation holes are positioned circumferentially between said lamp shade assembly and said base plate.

16. A motion sensing ceiling mount light, comprising:

a motion detector, a lamp housing, and a base plate, said motion detector having a spherical lens and a motion sensor, wherein said motion sensor has a downwardly directed 360-degree range viewing field;

said motion detector mounted to said base plate and positioned within said lamp housing, said lamp housing having an aperture through which said spherical lens extends.

17. A motion detector for lighting mounted to a ceiling, comprising a lamp shade assembly, a motion detector assembly, and a base plate, said motion detector having a spherical lens protruding through an opening in said lamp shade assembly, and a sensitivity regulating switch whereby motion sensitivity can be adjusted up to about 30 feet in any direction at an 8 foot mounting height, said motion sensor detecting motion in a 360-degree rang of viewing field.

18. The motion detector for lighting mounted to a ceiling of claim 17, wherein said opening is located at a midpoint of said lamp shade assembly and is circumscribed by a decorative ring.

19. The motion detector lighting mounted to a ceiling of claim 17, wherein a motion detector case envelops a printed circuit board assembly, said sensitivity regulating switch, a time regulating switch, and switch covers.

20. The motion detector for lighting mounted to a ceiling of claim 17, wherein a heat sink encircles said spherical lens.

21. The motion detector for lighting mounted to a ceiling of claim 17, wherein a rubber plug and an extension cylinder are positioned between a printed circuit board assembly and a heat shield, said extension cylinder being removably mounted on said base plate.

22. The motion detector for lighting mounted to a ceiling of claim 17, wherein a partition is positioned between a printed circuit board assembly and said spherical lens.

23. The motion detector for lighting mounted to a ceiling of claim 18, wherein said lamp shade assembly comprises a support frame and a frame base framing and supporting a bottom panel and a plurality of side panels, said frame base of said lamp shade assembly removably mounted to said base plate.

24. The motion detector for lighting mounted to a ceiling of claim 23, wherein said bottom panel and said side panels are glass panels.

25. The motion detector for lighting mounted to a ceiling of claim 23, wherein said bottom panel is partitioned into a plurality of individual panels.

26. The motion detector for lighting mounted to a ceiling of claim 17, wherein said motion sensor is a passive infrared sensor.

27. The motion detector for lighting mounted to a ceiling of claim 17, said base plate having a plurality of socket assemblies for one or more illumination sources and a mounting bracket for mounting said motion detector to said ceiling.

28. The motion detector for lighting mounted to a ceiling of claim 17, wherein ventilation holes are positioned between said lamp shade assembly and said base plate.

29. A ceiling mount light for sensing motion, comprising:

a) a motion detector having a spherical lens and a motion sensor with a 360-degree range viewing field positioned within said spherical lens; and b) a lamp shade having a support frame and a frame base framing a bottom panel and plurality of side panels, said bottom panel having a hollow recess; wherein, c) said frame base of said lamp shade is mounted to a base plate, and said motion detector is mounted to said base plate and positioned within said lamp shade such that said spherical lens of said motion detector protrude through said hollow recess in said lamp shade.

30. The ceiling mount light for sensing motion of claim 29, comprising a motion detector case, a switch cover, a time-regulating switch, and a sensitivity regulating switch, said switch case mounted on a rubber plug and an extension cylinder, said extension cylinder mounted on a heat shield.

31. A ceiling mount light for sensing motion, comprising:

a) a motion detector assembly having a spherical lens and a motion sensor with a 360-degree range viewing field positioned within said spherical lens; and b) a lamp shade assembly having a hollow recess; wherein, c) said lamp shade assembly is mounted to a base plate, and said motion detector assembly is mounted to said base plate and positioned within said lamp shade assembly such that said spherical lens of said motion detector assembly protrude through said hollow recess in said lamp shade assembly.

32. A motion-sensing ceiling mount light, comprising a motion detector assembly having a spherical lens and a motion sensor with a 360-degree range viewing field positioned within said spherical lens, wherein said motion detector assembly is positioned within a lamp shade assembly such that said spherical lens of said motion detector assembly protrudes through a hollow recess in said lamp shade assembly.

33. A motion-sensing ceiling mount light, comprising:

a motion detector, a lamp housing, and a base plate, said motion detector having a spherical lens and a motion sensor, wherein said motion sensor has a downwardly directed 360-degree range viewing field;

said motion detector mounted to said base plate and positioned within said lamp housing, said lamp housing having an aperture through which said spherical lens extends;

said motion detector electronically connected to a photocell and further having a dual light capability, said light emitting light at a lower luminance during a first condition and at a higher luminance when said motion sensor is activated.

* * * * *